US005199352A

United States Patent [19]

Sugiyama

[11] Patent Number: 5,199,352

[45] Date of Patent: Apr. 6, 1993

[54] PLATE LOCK-UP DEVICE FOR PRINTING PRESS

[75] Inventor: Hiroyuki Sugiyama, Ibaraki, Japan

[73] Assignee: Komori Corporation, Japan

[21] Appl. No.: 888,321

[22] Filed: May 26, 1992

Related U.S. Application Data

[63] Continuation of Ser. No. 766,952, Sep. 24, 1991, abandoned, which is a continuation of Ser. No. 485,172, Feb. 26, 1990, abandoned.

[51] Int. Cl.[5] ..... B41F 27/06

[52] U.S. Cl. ..... 101/378; 101/383; 101/415.1

[58] Field of Search ..... 101/383, 415.1, 378

[56] References Cited

U.S. PATENT DOCUMENTS

| | | | |
|---|---|---|---|
| 3,702,098 | 11/1972 | Eburn, Jr. | 101/415.1 |
| 3,795,193 | 3/1974 | John et al. | 101/415.1 |
| 3,976,005 | 8/1976 | Kaufmann | 101/415.1 |
| 3,994,224 | 11/1976 | Hill | 101/415.1 |
| 4,688,484 | 8/1987 | Herold et al. | 101/415.1 |
| 4,716,828 | 1/1988 | Hartung et al. | 101/415.1 |
| 4,739,704 | 4/1988 | Kitai | 101/415.1 |
| 4,759,290 | 7/1988 | Höll et al. | 101/415.1 |
| 4,831,931 | 5/1989 | Jeschke et al. | 101/415.1 |
| 4,938,135 | 7/1990 | Wieland | 101/415.1 |
| 4,977,833 | 12/1990 | Inage et al. | 101/378 |
| 5,003,878 | 4/1991 | Dorrow et al. | 101/378 |

*Primary Examiner*—Edgar S. Burr
*Assistant Examiner*—John S. Hilten
*Attorney, Agent, or Firm*—Blakely, Sokoloff, Taylor & Zafman

[57] ABSTRACT

A plate lock-up device for a printing press includes plate lock-up bases, a plurality of gripper plates, spring members, and a plurality of plate gripper cams. The plate lock-up bases extend in the axial direction of a plate cylinder and at least one of leading and trailing plate lock-up units is located in a gap formed in the circumferential surface of the plate cylinder. The gripper plates are pivotally supported by the plate lock-up bases and aligned in the axial direction of the plate cylinder. Each of the spring members is inserted between a corresponding one of the gripper plates and a corresponding one of the plate lock-up bases. The springs bias the corresponding gripper plate in a plate gripping direction. The plurality of plate gripper cams are aligned on pivot shafts and each is engaged with the corresponding gripper plate. The plate gripper cams cause the gripper plates to pivot in a plate release direction upon pivotal movement of the pivot shafts.

3 Claims, 4 Drawing Sheets

PLATE LOCK-UP DEVICE FOR PRINTING PRESS

This is a continuation of application Ser. No. 07/766,952 filed Sep. 24, 1991, now abandoned, which is a continuation of Ser. No. 07/485,172 filed Feb. 26, 1990, now abandoned.

BACKGROUND OF THE INVENTION

The present invention relates to a plate lock-up device mounted in a plate cylinder of a printing press to fix leading and trailing ends of a plate to be wound around the circumferential surface of the plate cylinder.

A gap having a substantially rectangular section is formed in the outer circumferential surface of a plate cylinder of each printing press so as to extend by almost the entire length of the plate cylinder. A plate lock-up device consisting of a leading plate lock-up unit for gripping the leading end, i.e., a gripper end, of the plate and a trailing plate lock-up unit for gripping the trailing end, i.e., an end opposite to the gripper end, of the plate cylinder is arranged in this gap and fixed on the bottom surface of the gap so as to extend in an axial direction of the cylinder.

Conventional leading and trailing plate lock-up units comprise elongated plate lock-up bases extending in the axial direction of a plate cylinder, a plurality of gripper plates pivotally supported by a plurality of bolts at edges of these plate lock-up bases and opened/closed upon pivoting to grip or release the plate with the plate lock-up plates, and a plurality of cams engaged with gaps of edges of the gripper plates. The plurality of cams are aligned along pivotal cam shafts. A plurality of compression coils springs are interposed between the plate lock-up bases and the gripper plates to bias the gripper plates in an open direction.

With the above structure, when a plate is to be gripped, the corresponding cam shaft is pivoted. Then, the gripper plates divided into a plurality of portions in the longitudinal direction of the plate cylinder are simultaneously released from engagement with the cams and are opened by an elastic force of the compression coil springs. The leading end of the plate is inserted between the gripper plates and the corresponding plate lock-up base, and the cam shaft is pivoted in a direction opposite to the direction described above. The gripper plates are pivoted and closed against the biasing forces of the compression coil springs by the action of the cams, thereby gripping the leading end of the plate.

The plate lock-up base of the trailing plate lock-up unit is supported on the bottom surface of the cylinder gap and is movable along the circumferential direction of the plate cylinder. A plurality of plate stretching bolts are threadably engaged at a plurality of positions in the longitudinal direction of this plate lock-up base such that the heads of the bolts abut against the wall surface of the gap of the plate cylinder.

With the above structure, after the leading end is gripped by the leading plate lock-up unit as described above is wound around the circumferential surface of the plate cylinder, the trailing end of the plate is gripped by the trailing plate lock-up unit. The plate lock-up bolts are tightened by circumferential movement of the trailing plate lock-up unit, and the plate is brought into tight contact on the circumferential surface of the plate cylinder. Spring members are inserted between the trailing plate lock-up unit and the gap. When the plate stretching bolts are loosened, the plate lock-up unit is moved toward the wall surface of the gap by the spring forces of the spring members and is loosened.

In such a conventional plate lock-up device, since a plurality of gripper plates are pivoted to pivot the cams so as to grip the plate, a gripping operation after adjustment of the gripper plates results in nonuniform gripping forces between the gripper plates. As a result, the plate tends to be deformed, and contact adjustment of the gripper plates is cumbersome to prolong the mounting time.

In the conventional plate lock-up device, as described above, since the plurality of plate stretching bolts are tightened to stretch the plate, it is difficult to uniformly stretch the plate, and mounting precision tends to be degraded. The plate stretching operation and the plate gripping operation must be performed at different work positions, resulting in cumbersome, time-consuming operations.

SUMMARY OF THE INVENTION

It is an object of the present invention to provide a plate lock-up device which can improve gripping precision and is free from cumbersome adjustment.

It is another object of the present invention to provide a plate lock-up device which can reduce a printing preparation time and improve productivity.

It is still another object of the present invention to provide a plate lock-up device which can improve precision of contact between the gripper plates and plate lock-up units.

In order to achieve the above objects of the present invention, there is provided a plate lock-up device for a printing press, comprising plate lock-up bases, extending in an axial direction of a plate cylinder, at least one of leading and trailing plate lock-up units being located in a gap formed in a circumferential surface of the plate cylinder, a plurality of gripper plates pivotally supported by the plate lock-up bases and aligned in the axial direction of the plate cylinder, spring members, each inserted between corresponding ones of the gripper plates and the plate lock-up bases, for biasing the corresponding gripper plate in a plate gripping direction, and a plurality of plate gripper cams, aligned on pivot shafts and each engaged with the corresponding gripper plate, for pivoting the gripper plates in a plate release direction upon pivotal movement of the pivot shafts.

One end of the plate is inserted between the open gripper plates and the leading plate lock-up base, and the corresponding pivot shaft is pivoted. The gripper plates are engaged with small-diameter portions of the corresponding gripper cams and can be pivoted, so that the gripper plates are pivoted by biasing forces of the spring members, thereby gripping the plate. After one end of the plate is gripped, the plate is wound around the circumferential surface of the plate cylinder. The other end of the plate is inserted between the open gripper plates and the trailing plate lock-up base. When the corresponding pivot shaft is pivoted, the gripper plates are engaged with the small-diameter portions of the corresponding gripper cams, and are free to pivot. The gripper plates are then pivoted by the biasing forces of the spring members, thereby gripping the plate.

When the same pivot shaft is further pivoted, the plate stretching cams are pivoted to move the trailing plate lock-up unit. The trailing plate lock-up unit is actually moved to stretch the plate, and the plate can be brought into tight contact with the circumferential surface of the plate cylinder.

DESCRIPTION OF THE PREFERRED EMBODIMENT

FIGS. 1 to 8 show a plate lock-up device for a printing press according to an embodiment of the present invention.

Figure 1:
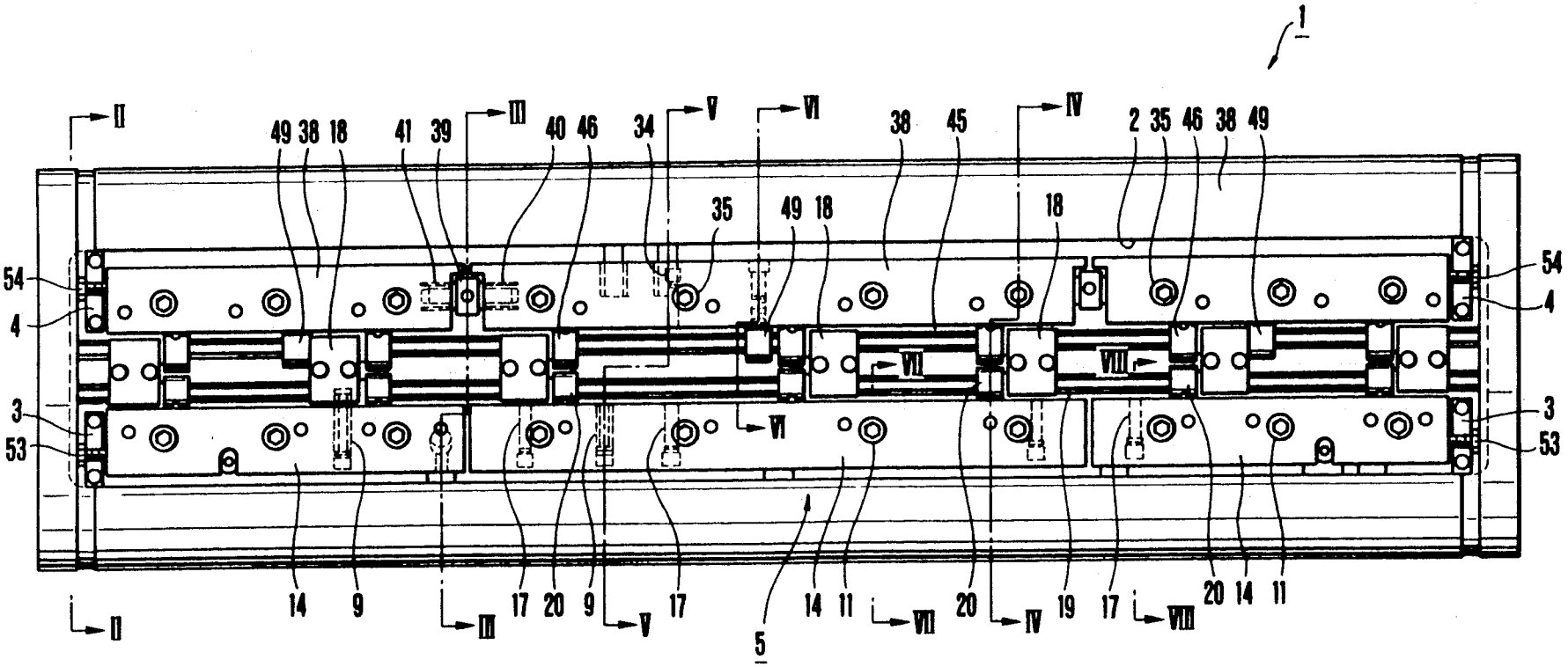
FIG. 1 is a plan view showing a plate cylinder and a plate lock-up device mounted in the plate cylinder of a printing press according to an embodiment of the present invention.
Figure 2:
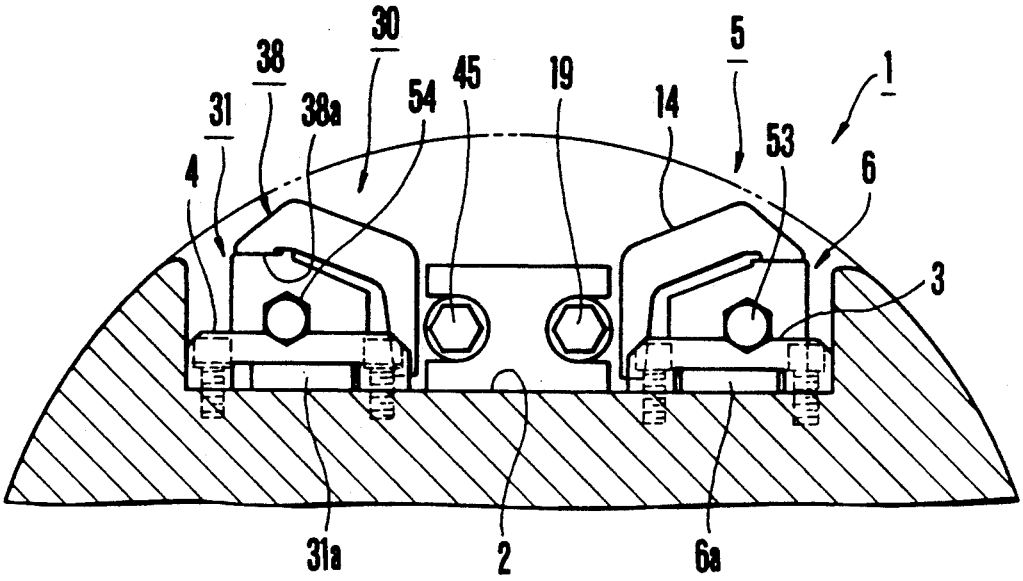
FIG. 2 is a sectional view of the structure of FIG. 1 along the line II—II thereof.
Figure 3:
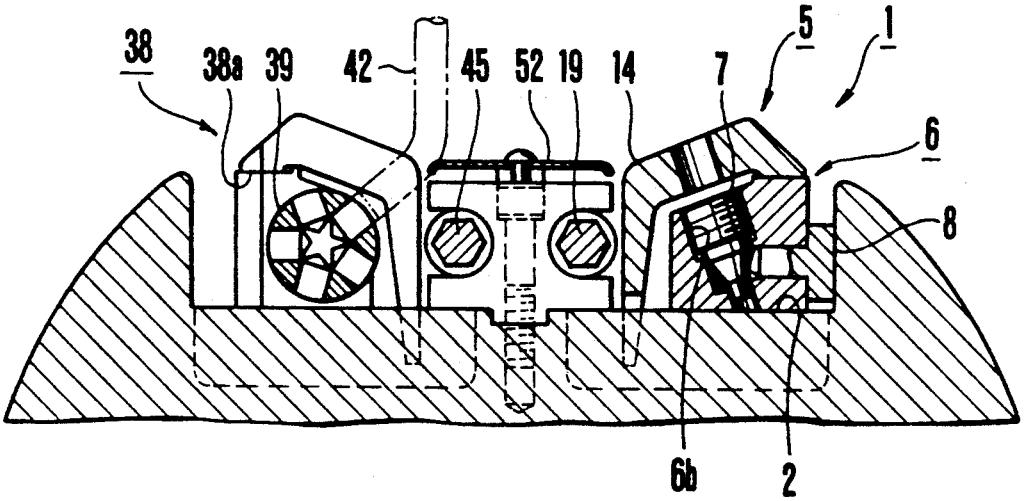
FIG. 3 is a sectional view of the structure of FIG. 1 along the line III—III thereof.
Figure 4:
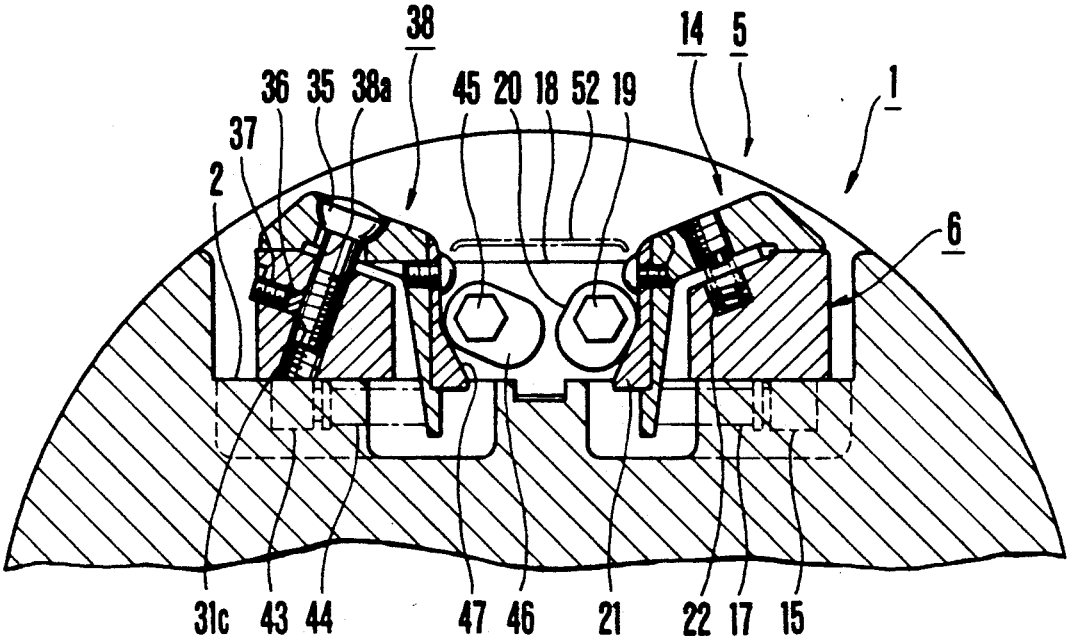
FIG. 4 is a sectional view of the structure of FIG. 1 along the line IV—IV thereof.
Figure 5:
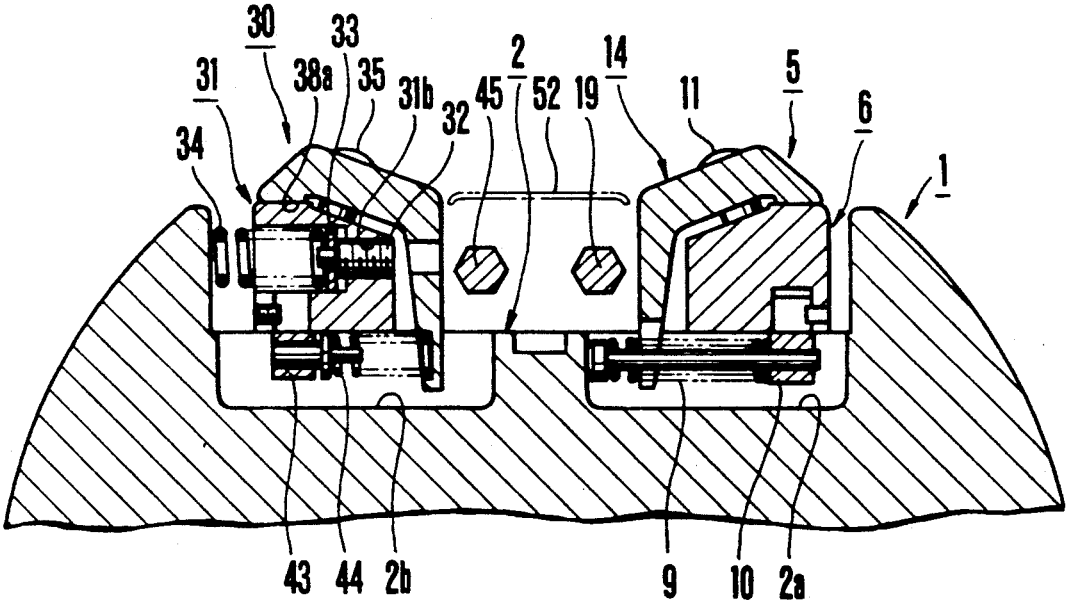
FIG. 5 is a sectional view of the structure of FIG. 1 along the line V—V thereof.

Referring to FIGS. 1 to 8, a gap 2 having a substantially rectangular section is formed in the outer circumferential surface of a plate cylinder 1 so as to extend by almost the entire length of the plate cylinder 1. A pair of guides 3 and 4 constituting saddle-like members are bolted on the bottom surface of the gap at each end portion of the gap 2. A leading plate lock-up unit 5 includes a plate lock-up base 6 having a substantially square section and extending in the axial direction of the plate cylinder. Thin-walled portions 6*a* at both ends of the plate lock-up base 6 are fitted in right and left guides 3 to restrict vertical movement of the thin-walled portions 6*a* and allow circumferential movement of these portions 6*a*. Screw holes 6*b* having a sectional shape shown in FIG. 3 are formed at a plurality of locations of the plate lock-up base 6 along its longitudinal direction. Adjusting screws 7 each having a tapered tip are threadably engaged with the screw holes 6*b*, respectively. Collared pins 8 are respectively inserted into pin holes at positions corresponding to the adjusting screws 7 such that collar portions are engaged in spaces between the plate lock-up base 6 and a wall surface of the gap 2. With this structure, when the adjusting screws 7 are rotated, the plate lock-up base 6 is finely moved and adjusted in the circumferential direction in cooperation with the tapered surfaces. Each compression coil spring 9 in FIG. 5 is inserted between a stud 10 on the plate lock-up base 6 side and a recessed hole 2*a* of the gap 2 to bias the plate lock-up unit 5 outward in the circumferential direction.

Figure 7:
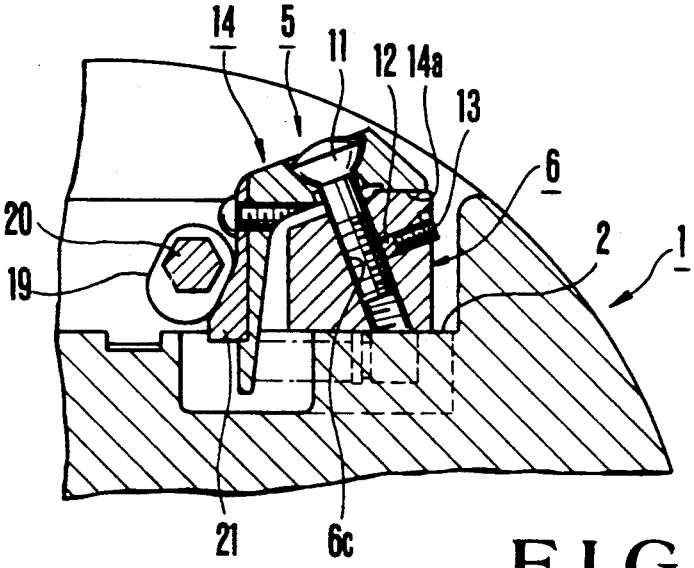
FIG. 7 is a sectional view of the structure of FIG. 1 along the line VII—VII thereof.
Figure 8:
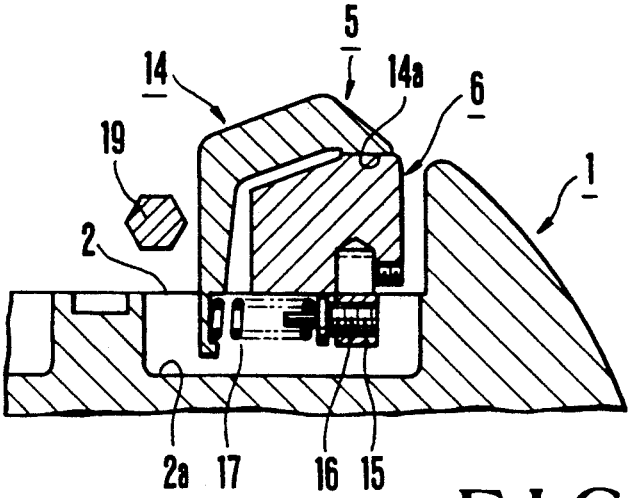
FIG. 8 is a sectional view of the structure of FIG. 1 along the line VIII—VIII thereof.

Screw holes 6*c* having a sectional shape shown in FIG. 7 are formed at a plurality of positions of the inclined surface of the plate lock-up base 6. A pin 11 having a semispherical head is threadably engaged with the corresponding screw hole 6*c* and is fixed by a set screw 13 through a plastic chip 12. Three gripper plates 14 divided in the axial direction of the plate cylinder and having an overall length almost equal to that of the plate lock-up base 6 are pivotally supported on the plate lock-up base 6 such that the semispherical head of the corresponding pin 11 is fitted in its hole. Each gripper plate 14 is a substantially L-shaped member. A gripper surface 14*a* of each gripper plate 14 opposes the gripper surface of the plate lock-up base 6. Although not shown, a plurality of projections are formed on the gripper surface 14*a* and are engaged with recessed grooves of the opposite gripper surface of the plate lock-up base 6. A plurality of studs 15 each having a sectional shape shown in FIG. 8 extend into the recessed holes 2*a* of the gap 2 and are aligned in the axial direction of the plate cylinder. Each compression coil spring 17 is inserted between a spring seat pin 16 threadably engaged with the screw hole of each stud 15 and the recessed hole at the lower end of the corresponding gripper plate 14. The compression coil spring 17 biases the corresponding gripper plate 14 in a direction to close the gripper surface 14*a*. A plurality of box-like bearings 18 aligned in the axial direction of the plate cylinder are bolted at the central portion of the bottom surface of the gap 2. A cam shaft 19 having a hexagonal section is pivotally supported by the bearings 18 such that portions having a circular section are fitted in the bearings 18. A plurality of plate gripper cams 20 each having large- and small-diameter portions are mounted on the cam shaft 19 in the axial direction. Subplates 21 are aligned in the axial direction of the plate cylinder and are screwed on the vertical surfaces of the gripper plates 14 in correspondence with the gripper cams 20, respectively. When a portion of the cam shaft 19 which is exposed from a cover 52 is pivoted with a wrench, the large-diameter portions of the gripper cams 20 cause the gripper plates 14 to pivot against the biasing forces of the compression coil springs 17 to open the gripper surfaces 14*a*, respectively. Referring to FIG. 4, reference numeral 22 denotes a compression coil spring inserted between the plate lock-up base 6 and the corresponding gripper plate 14 to bias the corresponding gripper plate 14.

A trailing plate lock-up unit 30 arranged parallel to the leading plate lock-up unit 5 in the gap 2 has a plate lock-up base 31 having a square section and extending in the axial direction of the plate cylinder. Two thin-walled portions 31*a* are fitted in the right and left guides 4 so that vertical movement of the thin-walled portions 31*a* of the plate lock-up base 31 is restricted by right and left guides 4, but their circumferential movement is allowed. Screw holes 31*b* having a sectional shape shown in FIG. 5 are formed at a plurality of positions of the plate lock-up base 31 in its longitudinal direction. Spring seat pins 32 are threadably engaged with the screw holes 31*b*. Each compression coil spring 34 is inserted in the corresponding spring hole of the plate lock-up base 31 between a wall surface of the gap 2 and a corresponding washer 33 mounted on the corresponding spring seat pin 32 in a direction to separate the trailing plate lock-up unit 30 from the wall surface of the gap 2, i.e., in a plate stretching direction (to be described later).

Screw holes 31*c* each having a sectional shape shown in FIG. 4 are formed at a plurality of positions of the inclined surface of the plate lock-up base 31. A pin 35 having a semispherical head is threadably engaged with each screw hole 31*c* and is fixed by a corresponding set screw 37 through a corresponding plastic chip 36. Three gripper plates 38 divided in the axial direction of the plate cylinder and having an overall length corresponding to the overall length of the plate cylinder are pivotally supported such that the semispherical heads of the pins 35 are fitted in their holes, respectively. Each gripper plate 38 is a substantially L-shaped member. A gripper surface 38*a* of each gripper plate 38 opposes a corresponding gripper surface of the plate lock-up base 6. Although not shown, a plurality of projections are formed on each gripper surface 38*a* and are engaged with recessed grooves of the opposite gripper surface. Reference numerals 39 denote adjusting collars formed at boundaries of the divided plate lock-up bases 31. A right screw 40 and a left screw 41 are integrally formed with each collar 39. The right and left screws 40 and 41 are respectively engaged with the central plate lock-up base and each of the end plate lock-up bases. When the adjusting collars 39 are pivoted upon insertion of a tool 42, as shown in FIG. 3, the overall length of the plate lock-up bases 31 and gripper plates 38 can be slightly changed. A compression coil spring 44 is inserted between the lower end of the corresponding gripper plate 38 and a stud 43 supported on the bottom surface of the plate lock-up base 31 and extending in the corresponding recessed hole 2*b* of the gap 2 to bias the corresponding gripper plate 38 in a direction to close the corresponding gripper surface 38*a*. A cam shaft 45 having a hexagonal section and parallel to the cam shaft 19 is pivotally supported by the bearings 18 so that portions each having a circular section are fitted in the bearings 18, respectively. A plurality of plate gripper cams 46 each having large- and small-diameter portions are aligned along the cam shaft 45 so as to have the same phase as the plate gripper cams 20. Subplates 47 are screwed on the vertical surfaces of the gripper plates 38 in correspondence with the gripper cams 46, respectively. When a wrench is engaged with a portion of the cam shaft 45 exposed from the cover 52 to pivot the cam shaft 45, the large-diameter portion of the plate gripper cam 46 is engaged with the corresponding subplate 47 to cause the corresponding gripper plate 38 to pivot clockwise against the biasing force of the corresponding compression coil spring 44, thereby opening the corresponding gripper surface 38*a*.

A plurality of plate stretching cams 49 each having large- and small-diameter portions are mounted on the cam shaft 45 and aligned in the axial direction of the plate cylinder so as to have a phase different from that of the plate gripper cams 46. Subplates 50 are fixed by bolts 51 on the vertical surfaces of the plate lock-up base 31 in correspondence with the plate stretching cams 49, respectively. When a wrench is engaged with the portion of the cam shaft 45 exposed from the cover 52 to pivot the cam shaft 45, the trailing plate lock-up unit 30 can be pivoted by the large-diameter portions of the plate stretching cams 49 through the subplates 50 toward the wall surface of the gap against the biasing forces of the compression coil springs 34, respectively. Therefore, the plate gripped by the gripper plates 38 can be loosened. Reference numeral 52 denotes the cover having several openings formed in the axial direction to allow engagement between a wrench and each of the cam shafts 10 and 45, so as to cover portions above the cam shafts 19 and 45; 53 and 54, adjusting bolts for finely moving the plate lock-up units 6 and 31 in the axial direction of the plate cylinder and fixing them at proper positions.

An operation of the plate lock-up device having the above structure will be described below. When a wrench is engaged with the portion of the cam shaft 19 exposed from the cover 52 in the illustrated state, the plate gripper cams 20 are pivoted, and their large-diameter portions are brought into slidable contact with the corresponding subplates 21. The gripper plates 14 are pivoted counterclockwise against the biasing forces of the compression coil springs 17, respectively, so that the gripper surfaces 14*a* of the gripper plates 14 are opened. One end of the plate is inserted between the gripper surfaces 14*a* and the mating gripper surfaces of the plate lock-up base 6. When the cam shaft 19 is pivoted in a direction opposite to that of the above operation, the plate gripper cams 20 are pivoted so that the small-diameter portions of the cams 20 are brought into slidable contact with the corresponding subplates 21. The gripper plates 14 are released by the plate gripper cams 20 and pivoted clockwise by the elastic forces of the compression coil springs 17. The gripper surfaces 14*a* are closed to grip one end of the plate. In this case, equal spring forces of the compression coil springs 17 are applied to the gripped portions, and therefore uniform forces are applied throughout the width of the plate.

After one end of the plate is gripped, when the plate cylinder is rotated by about one revolution, the plate is wound around the circumferential surface of the plate cylinder 1. A wrench is engaged with the end of the cam shaft 45 exposed from the cover 52 in the illustrated state, the plate gripper cams 46 are pivoted so that their large-diameter portions are brought into contact with the corresponding subplates 47. The gripper plates 38 are pivoted clockwise against the elastic forces of the compression coil springs 44, respectively, and the gripper surfaces 38*a* of the gripper plates 38 are opened. The other end of the plate is inserted between the gripper surfaces 38*a* and the gripper surfaces of the plate lock-up base 31. The cam shaft 45 is pivoted in a direction opposite to that of the above operation, and the plate gripper cams 46 are pivoted so that their small-diameter portions are brought into contact with the corresponding subplates 47. The gripper plates 38 are released by the plate gripper cams 46, and then the gripper plates 38 are pivoted counterclockwise by the elastic forces of the corresponding compression coil springs. The gripper surfaces 38*a* are closed to grip the other end of the plate. Equal spring forces of the compression coil springs 44 are applied to the gripped portions, and the plate is uniformly gripped throughout its width. At this time, the large-diameter portions of the plate stretching cams 49 abut against the corresponding subplates 50, and the trailing plate lock-up unit 30 is kept moved in a direction to come close to the wall surface of the gap 2. In this state, the plate is not stretched yet.

Figure 6:
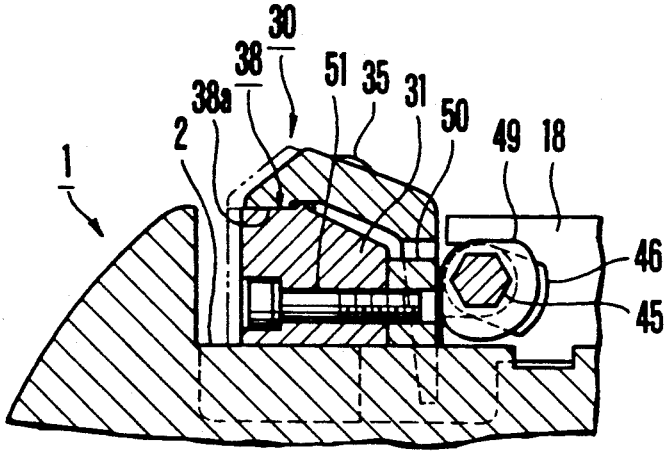
FIG. 6 is a sectional view of the structure of FIG. 1 along the line VI—VI thereof.

When a wrench is engaged with the extended end portion of the cam shaft 45 to pivot it to a state shown in FIG. 6, the small-diameter portions of the plurality of plate stretching cams 49 simultaneously abut against the corresponding subplates 50, the trailing plate lock-up unit 30 is released by the plate stretching cams 49. The trailing plate lock-up unit 30 is moved away from the wall surface of the gap 2 by the compression coil springs 34, and the plate is stretched and brought into tight contact with the circumferential surface of the plate cylinder 1. In this case, since the plate is stretched by the elastic forces of the compression coil springs 34, it is stretched with a uniform tension throughout its width.

When the plate is to be removed from the plate cylinder, the cam shaft 45 is pivoted to bring the large-diameter portions of the plate stretching cams 49 into contact with the corresponding subplates 50. The trailing plate lock-up unit 30 is moved in the direction of the wall surface of the gap 2 and and the plate is loosened. When the cam shaft 45 is further pivoted to bring the large-diameter portions of the plate gripper cams 46 into contact with the subplates 47, the gripper plates 38 are opened to release one end of the plate. When the plate cylinder 1 is rotated by about one revolution, the plate is unwound from the plate cylinder. When the cam shaft 19 is pivoted to bring the large-diameter portions of the cam shafts 19 into contact with the corresponding subplates 21, the gripper plates 14 are opened, and the other end of the plate is released, thereby completing removal of the plate.

As described above, the cams located at positions close to each other are pivoted to grip/release both the ends of the plate and to stretch/loosen the plate.

As is apparent from the above description, according to the present invention, the plate lock-up device comprises plate lock-up bases, extending in the axial direction of the plate cylinder, at least one of leading and trailing plate lock-up units being located in a gap formed in a circumferential surface of the plate cylinder, a plurality of gripper plates pivotally supported on the plate lock-up bases and aligned along the axial direction of the plate cylinder, spring members located between the gripper plates and the plate lock-up bases to bias the gripper plates in a plate gripping direction, and a plurality of plate gripper cams engaged with the corresponding gripper plates and aligned on the pivot shafts on the plate lock-up bases to pivot the gripper plates in a plate release direction upon pivotal operation of the pivot shafts. The equal spring forces of the spring members are applied to both the ends of the plate throughout its width, and gripping precision can be improved. At the same time, cumbersome adjustment of the gripper plates need not be performed, and plate gripping and release operations are performed at substantially one position. A plate preparation time can be shortened, and productivity is improved.

In addition to the above structure, at least one of the plate lock-up bases is arranged to be movable in the circumferential direction of the plate cylinder. The plate lock-up device further includes spring members, inserted between the movable plate lock-up base and the wall surface of the gap of the plate cylinder to bias the movable plate lock-up base, and a plurality of plate stretching cams aligned on one of the pivot shafts to move the movable plate lock-up base in a plate release direction upon pivotal movement of the pivot shaft. Since the plate is stretched by the spring forces of the spring members, a uniform tension is applied to the plate throughout its entire width. Therefore, the plate will not be deformed and contact precision can be improved. Unlike the conventional arrangement using a large number of bolts for gripping both the ends of the plate on the plate cylinder and releasing the ends of the plate therefrom, gripping and release of both the ends of the plate can be performed at substantially one position upon pivotal movement of the cam shafts. Therefore, the plate preparation time can be further reduced, productivity can be improved, and labor can be reduced.

What is claimed is:

1. A plate lock-up device for a printing press including leading and trailing plate lock-up units which comprises:

at least one of said plate lock-up units being located in a gap formed in a circumferential surface of a plate cylinder and mounted to said plate cylinder in said gap so as to be movable in the circumferential direction of said cylinder, said at least one plate lock-up unit having plate lock-up bases extending from said plate lock-up unit in an axial direction of said plate cylinder;

a plurality of gripper plates pivotally supported by said plate lock-up bases and aligned in the axial direction of said plate cylinder;

first spring members, each inserted between corresponding ones of said gripper plates and said plate lock-up bases, for pivoting said corresponding gripper plates with respect to said corresponding plate lock-up bases in a plate gripping direction; and a plurality of plate gripper cams, aligned on pivot shafts adjacent to said at least one plate lock-up unit, each plate gripper cam engaged with said corresponding gripper plate, for pivoting said gripper plates with respect to said corresponding plate lock-up bases in a plate release direction upon pivotal movement of said pivot shafts a plurality of plate stretching cams, aligned on at least one of said pivot shafts, said plate stretching cams having a different phase from said plate gripper cams on said at least one pivot shafts such that said gripper cams grip said plate before said plate stretching cams stretch the plate.

2. A plate lock-up device for a printing press including leading and trailing plate lock up units which comprises:

at least one of said plate lock-up units being located in a gap formed in a circumferential surface of a plate cylinder and mounted to said plate cylinder in said gap so as to be movable in the circumferential direction of said cylinder, said at least one plate lock-up unit having plate lock-up bases extending from said at least one plate lock-up unit in an axial direction of said plate cylinder;

a plurality of gripper plates pivotally supported by said plate lock-up bases and aligned in the axial direction of said plate cylinder;

first spring members, each inserted between corresponding ones of said gripper plates and said plate lock-up bases, for pivoting said corresponding gripper plates with respect to said corresponding plate lock-up bases in a plate gripping direction;

a plurality of plate gripper cams, aligned on pivot shafts adjacent to said at least one plate lock-up unit, each plate gripper cam engaged with said corresponding gripper plate, for pivoting said gripper plates with respect to said corresponding plate lock-up bases in a plate release direction upon pivotal movement of said pivot shafts;

second spring members, inserted between said movable plate lock-up bases and a wall surface of said gap of said plate cylinder, for moving said movable plate lock-up base in a plate stretching direction, and a plurality of plate stretching cams, aligned on at least one of said pivot shafts, for moving said movable plate lock-up base in a plate loosening direction upon pivotal operation of said at least one of said pivot shafts, said plate gripper cams having a different phase from said plate stretching cams such that said plate gripper cams engage and hold the plate before said stretching cams stretch the plate.

3. A device according to claim 2, wherein said plate gripper cams on said at least one of said pivot shafts have the same phase as said plate gripper cams on a remaining pivot shaft.

* * * * *